US008556202B2

(12) United States Patent
Langel

(10) Patent No.: US 8,556,202 B2
(45) Date of Patent: Oct. 15, 2013

(54) ROLLER GRINDING MILL

(75) Inventor: Joerg Langel, Koeln-Porz (DE)

(73) Assignee: Loesche GmbH, Duesseldorf (DE)

( * ) Notice: Subject to any disclaimer, the term of this patent is extended or adjusted under 35 U.S.C. 154(b) by 246 days.

(21) Appl. No.: 12/990,916

(22) PCT Filed: Jan. 26, 2010

(86) PCT No.: PCT/EP2010/000466
§ 371 (c)(1),
(2), (4) Date: Nov. 3, 2010

(87) PCT Pub. No.: WO2010/108564
PCT Pub. Date: Sep. 30, 2010

(65) Prior Publication Data

US 2011/0155831 A1 Jun. 30, 2011

(30) Foreign Application Priority Data

Mar. 26, 2009 (DE) ..... 10 2009 015 037

(51) Int. Cl.
*B02C 15/00* (2006.01)

(52) U.S. Cl.
USPC ..... 241/119

(58) Field of Classification Search
USPC ..... 241/117–121
See application file for complete search history.

(56) References Cited

U.S. PATENT DOCUMENTS 1,840,366 A 1/1932 Loesche
3,556,419 A * 1/1971 Frangquist et al. ..... 241/61
4,234,132 A * 11/1980 Maliszewski, Jr. ..... 241/53
4,605,174 A * 8/1986 Maliszewski et al. ..... 241/52
4,694,994 A * 9/1987 Henne et al. ..... 241/79.1

(Continued)

FOREIGN PATENT DOCUMENTS

DE 717920 C 2/1942
DE 1 507 580 A1 4/1969

(Continued)

OTHER PUBLICATIONS

International Preliminary Report on Patentability and the Written Opinion of the International Searching Authority dated Sep. 27, 2011; International Application No. PCT/EP2010/000466.

(Continued)

*Primary Examiner* — Faye Francis
(74) *Attorney, Agent, or Firm* — Studebaker & Brackett PC

(57) ABSTRACT

The invention relates to a roller mill having a grinding pan which is rotatable about a mill axis, on the grinding track of which grinding pan stationarily disposed grinding rollers roll and thereby define with their circumferential surfaces on the grinding track a running circle with an inner diameter and an outer diameter, and having a grinding material distributor for grinding material to be reduced, which is arranged as an elevation in the centre of the grinding pan coaxially with respect to the mill axis and rotates with the grinding pan.
In order to achieve an improved inflow of the grinding material to the grinding rollers and an increased throughput performance of the roller mill a distributing plate is provided as the grinding material distributor, which is arranged at a defined distance from the grinding rollers and is thereby designed and dimensioned in such a way that there is a defined ratio between the inner diameter of the rolling circle and the diameter of the distributing plate at the level of the grinding track.

19 Claims, 2 Drawing Sheets

(56) References Cited

U.S. PATENT DOCUMENTS

Figure 1:
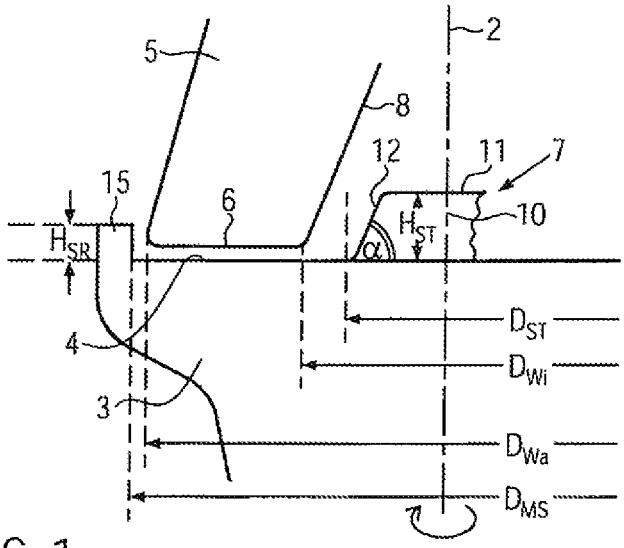

| | | | | | |
|---|---|---|---|---|---|
| 4,798,344 | A | * | 1/1989 | Fishburn | 241/79.1 |
| 5,039,021 | A | | 8/1991 | Eisinger | |
| 5,244,157 | A | * | 9/1993 | Brundiek | 241/36 |
| 5,381,968 | A | | 1/1995 | Lohnherr et al. | |
| 5,904,307 | A | * | 5/1999 | Prairie et al. | 241/117 |
| 5,957,300 | A | * | 9/1999 | Nardi et al. | 209/143 |
| 5,971,302 | A | * | 10/1999 | Doumet | 241/17 |
| 6,644,576 | B1 | * | 11/2003 | Hicklin | 241/119 |
| 7,100,853 | B2 | * | 9/2006 | Wark | 241/119 |
| 2004/0227024 | A1 | | 11/2004 | Biswas et al. | |

FOREIGN PATENT DOCUMENTS

| | | | |
|---|---|---|---|
| DE | 41 24 416 | A1 | 1/1993 |
| DE | 19651103 | A1 | 6/1998 |
| EP | 0 141 982 | A2 | 5/1985 |
| GB | 428237 | A | 5/1935 |
| GB | 1 453 548 | A | 10/1976 |

OTHER PUBLICATIONS

International Search Report; PCT/EP2010/000466; Jul. 27, 2010.

* cited by examiner

ROLLER GRINDING MILL

The invention relates to a roller mill according to the introductory clause of claim 1.

Roller mills which comprise a grinding pan or a grinding plate with a planar grinding track with or without a retention rim on the outer periphery and also two, three, four or six grinding rollers which roll on the grinding track or on a grinding bed formed thereon by supplied grinding material are known from DE 102 24 009 B4, DE 31 00 341 A1 and DE 31 34 601 C2. The grinding rollers are conically formed and are arranged so that a pre-definable, parallel grinding gap is formed between the roller shell of the grinding rollers and the grinding track.

The grinding material to be reduced is generally supplied laterally via a tip chute, whereby this is disposed so that the grinding material reaches a central region of the rotating grinding pan. The grinding material then moves through the effect of centrifugal forces spirally on the planar grinding track towards the grinding rollers and is reduced in size.

In case of overflow mills the fine and coarse material passes via the edge of the grinding pan and falls downwards into a grinding material outlet.

In case of air swept roller mills the fine material and the coarse material portions are fed to a classifier arranged above the grinding area. The fine material is expelled and the coarse material particles pass via a coarse particles cone back to the central region of the grinding pan and under the grinding rollers.

Air swept roller millers of the LOESCHE type have a retention rim on the grinding pan or on the grinding plate periphery, the height of which is determined by the mill size, the number of grinding rollers, the grinding material to be ground and the fineness of the ground product to be achieved. For the grinding of cement raw material, retention rim heights in the range of from around 50 to 130 mm are used and for the grinding of cement clinker, granulated sand and similar, retention rim heights are usual which can be from around 150 to 400 mm.

Roller mills with spherical grinding rollers and with a complementarily formed grinding track comprise a raised discharge edge (DE 19 851 103 A1) or are likewise provided with a retention rim (DD-PS 106 953, DE 197 23 100 A1).

It is known that a device for grinding material distribution can be arranged in the feed area of the grinding area or in the central region of the grinding pan, respectively, in order to achieve a regular supply of the material to be ground to the grinding rollers and hence a virtually uniform reduction work of the individual grinding rollers, a smooth running of the roller mill and all in all a grinding output that is as high as possible and the desired fineness of the ground product.

Grinding plates are known from DE 31 00 341 A1 and DE 31 34 601 C2 with a raised central part. The central part is formed as a very flat, relatively broad truncated cone and integrated into the grinding plate. The central part has the same height as the retention rim of the planar grinding plate.

The air swept roller mills described in DD-PS 136 799 and DD-PS 136 800 comprise a flat, planar grinding plate and a central two-part feed cone which consists of a relatively wide, lower truncated cone and a flat, upper cone. The two-part feed cone is two to three times higher than a retention rim on the grinding plate periphery. A feed tip chute is arranged in a decentralised manner above the feed cone and the feed material passes irregularly below the grinding rollers arranged at a different distance from the mill axis and hence from the feed cone.

AT-PS 189 039 discloses a roller mill with a grinding pan, of which the central truncated cone shaped region is provided with vanes which are intended to convey the feed material into the intermediate spaces between the grinding rollers. At the same time the air supply to the grinding pan is divided, whereby the air is also intended to reach in particular these intermediate spaces. These additional devices are intended to ensure that fluctuations in the throughput rate of the mill are avoided and that a more lower energy requirement is achieved. The radially upwardly orientated vanes are formed on the downwardly tapered circumferential surface of the truncated cone and the grinding track connecting to the circumferential surface is formed so as to ascend upwardly and outwardly. A retention rim on the outer edge of the grinding pan has a greater height than the central truncated cone shaped region of the grinding pan.

DE 38 34 965 A1 discloses a vertical roller mill with a planar grinding pan without a retention rim and with a raised circularly cylindrical central region. Above this central region of the grinding pan is an additional feed device provided with sensors which is height adjustable for a continuous material supply without idling. Fixed or adjustable scrapers are assigned to the roller mills which are arranged above the central region and are intended to ensure an even distribution of the grinding material from the central region outwards under the grinding rollers.

DE 197 23 100 A1 discloses a roller mill, wherein the grinding material reaches a central material distributing plate of the grinding pan. Said material distributing plate is formed cover-like and can be designed to rotate with the grinding pan or also to be stationary. Inner and outer material guide vanes and also gas deflection devices on the mill housing are intended to guarantee an even grinding material distribution together with the central material distributing plate.

DE 196 51 103 A1 describes a roller mill, of which the rotating grinding plate is provided with a central circular plate. An additional separation device is disposed on or above this circular plate, with the aid of which a lower grinding bed layer predominantly comprising fine material and a second grinding bed layer, mostly of coarse material, lying above it, are to be formed. An adequate ventilation of the grinding bed, in particular with the supply of relatively large amounts of fine material, is thereby to be achieved. The additional separation device is an annular separation comb element widening conically upwards and outwards and which is fixed concentrically on the grinding plate. In an alternative embodiment, a material distribution device is provided in place of the separation device. The central circular plate comprises a central distributor cone for the returned coarse particles which are to form the lower grinding bed layer, and the larger grain feed material is fed via a plurality of feeds which run via a transitional section from a slightly raised, central circular plate to the troughed grinding track.

The known truncated cone shaped and circularly cylindrical grinding material distributors in the centre of the grinding pan or the grinding plate are not suited in the required way for guaranteeing an even distribution of the feed material to the grinding rollers and a virtually uniform grinding bed on the grinding track. The additional devices such as vanes, scrapers, guide vanes, separating combs elements, in association with additional air conveying elements and/or a plurality of coaxially arranged feeds for the feed material, are relatively expensive, and prone to wear and can have a negative effect upon the pressure conditions in the grinding area and hence upon the energy balance of the grinding process and the throughput rate of the roller mill.

It is the object of the invention to create a constructively simply, cost-effective grinding material distributor for roller mills, with which the described drawbacks of the known solutions can be avoided and with which particularly good throughput rates of the roller mills can be achieved.

According to the invention the object is achieved through the features of claim 1. Useful and advantageous embodiments are contained in the description of the drawings and in the subclaims.

A fundamental idea of the invention can be seen in the use of a distributing plate as a grinding material distributor which is formed and dimensioned in relation to the grinding rollers and to the retention rim or respectively to a discharge edge of the grinding pan, and also has a design or forming which improves the grinding material distribution and supply to the grinding track and under the grinding rollers, and contributes to an increase in the throughput performance of the roller mill and to a considerable reduction in the grinding energy.

It has been found that a distributing plate which is arranged as an elevation in the centre of the grinding pan is to be dimensioned so that the distance from the lateral area or the shell surface of the distributing plate to the end faces of the grinding rollers extraordinarily improves the grinding material distribution. The end faces of the grinding rollers are thereby the faces orientated in the direction of the mill axis and circumferential surfaces as rolling surfaces of the grinding rollers define, on the grinding track of the grinding pan, a running circuit or circle in the form of a circular ring with an inner diameter $D_{Wi}$ and an outer diameter $D_{Wa}$.

Trials have shown that the distance of the end face of the grinding rollers from the shell surface of the distributing plate can be in the region of 80 mm in case of small roller mills and up to 400 mm in case of large roller mills in order to achieve an optimum distribution of the grinding material.

According to the invention the distributing plate has a virtually horizontally arranged feed area for the grinding material and is formed with a diameter $D_{ST}$ which satisfies the equation $$80\text{ mm} \leq \tfrac{1}{2}[D_{Wi} - D_{ST}] \leq 400\text{ mm}$$

The diameter $D_{ST}$ of the distributing plate is thereby the diameter at the level of the grinding track or respectively at the transition from the distributing plate to the grinding track, and this diameter is set in a relation to the inner diameter $D_{Wi}$ of the running circuit of the grinding rollers on the grinding track.

Small roller mills in this connection are understood to be roller mills with a grinding pan diameter of around 1.2 to 2.0 m and with in particular two grinding rollers. Large roller millers are equipped with two, three, four and more, for example six rollers, and the grinding pans can have diameters of around 2.1 to over 6 m.

It is particularly advantageous to provide roller mills of the LOESCHE type which have a grinding pan or respectively a grinding table with a horizontal grinding track and conical grinding rollers rolling thereon, with a distributing plate formed as a truncated cone and to form them with a height $H_{ST}$ (height of distributing plate) in dependence upon the height $H_{SR}$ of a retention ring on the grinding pan periphery.

In principle the height of the retention ring of the grinding pan is selected in dependence upon the feed material to be ground and the desired fineness of the grinding product. In case of roller mills of the LOESCHE type with conical grinding rollers and a planar grinding track the height of the retention ring in case of grinding of cement raw material is around 50 to 130 mm and in case of grinding of cement clinker or respectively granulated sand around 150 to 400 mm. It was found in trials that a distributing plate brings about an extraordinarily advantageous distribution of the feed material, of which the height is greater than or at least equal to the height of the retention ring. For certain mill sizes and selected grinding processes, however, it can also be advantageous to form the distributing plate to be lower than the retention ring. In principle the height $H_{ST}$ of the distributing plate can be in the region of 60 to 250% of the height $H_{SR}$ of the retention ring, so that the equation $$0.6H_{SR} \leq H_{ST} \leq 2.5H_{SR}$$

applies.

Trials have shown that the distributing plate can also be formed as a circularly cylindrical elevation in order to guarantee efficient distribution and supply of the grinding material to the grinding track and under the grinding rollers.

In principle the horizontal feed area of the inventive distributing plate can have a diameter which is greater than the grinding track width.

It is advantageous in case of a truncated cone shaped distributing plate if the frustum angle $\alpha$, that is the inclination of the shell surface of the truncated cone in relation to its base area, is in the region of around 45° to close to 90°. For example the frustum angle $\alpha$ can be 45, 50, 55, 60, 65, 70, 75, 80, 85 or 89°, whereby it is useful in the case of a truncated cone shaped distributing plate with a greater height than the retention ring height to select a frustum angle $\alpha$ in the range of approximately 45° to 75°, while truncated cone shaped distributing plates with a lower height than the retention ring can have frustum angles in the range of from 65° to 85°. It has been found that a distributing plate with a frustum angle of about 70° has particularly advantageous effects, particularly having regard to the smooth running of the mill and energy saving. This can be explained, inter alia, with a vertical force component in case of a larger frustum angle in effective combination with an inclined sliding or rolling surface in the direction of the grinding track.

The upper feed area of the distributing plate can be formed as a plane. In dependence upon the feed material to be ground it can also prove useful to form the feed area in the direction of the mill axis to be upwardly or downwardly inclined or spherically curved, that is to say concavely or convexly curved, whereby the inclination angle $\beta$ is then maximum 10° and hence can be 1, 2, 3, 4, 5, 6, 7, 8, 9, 10°.

It has been shown in trials that a concave or convex formation of the shell surface of a truncated cone shaped or circularly cylindrical distributing plate can also be advantageous for the distribution of the grinding material. The inclination angle $\gamma$ of the inwardly or outwardly curved shell surface can advantageously be maximum 5°, that is to say 1, 2, 3, 4 or 5°.

Rounded-off transition areas are additionally advantageous which can be formed between the feed area and the shell surface of the distributing plate and between the shell surface of the distributing plate and the adjacent grinding track and enhance the flowing away of the feed material from the feed area and the shell surface of the distributing plate.

In case of roller mills with grinding pans which have an inclined or trough-shaped grinding track and complementarily formed conical or spherical grinding rollers a discharge edge on the outer edge of the grinding pan or respectively the grinding track can be equated to the retention ring. The height $H_{AK}$ of the discharge edge then corresponds to the height of the retention ring. In principle it is advantageous if the ratio height $H_{ST}$ of the distributing plate to the height $H_{AK}$ of the discharge edge is 1.2 to 2.2:1, that is to say, the distributing plate is formed 1.2 to 2.2 times higher than the discharge edge, whereby the height of the discharge edge is measured from the deepest point of the grinding track.

Grinding mills with a distributing plate formed according to the invention exhibit improved flow of the grinding material to and under the grinding rollers, by reason of the centrifugal force and gravity effect upon the grinding material. Trials have shown that the throughout rate of roller mills could be increased by up to 10% and the grinding energy could be lowered by up to 10%. Based on the inventive arrangement and formation of the distributing plate, in particular its dimensioning and distance from the grinding rollers in the form of the inner diameter of the running circuit of the grinding rollers and the diameter of the distributing plate at the level of the grinding track, it has been ascertained as a further particular effect that the grinding material thrown back from the end faces of the grinding rollers in the direction of the mill axis is held by the distributing plate, that is to say by its shell surface, on the grinding track and efficiently transported under the grinding rollers.

Figure 2:
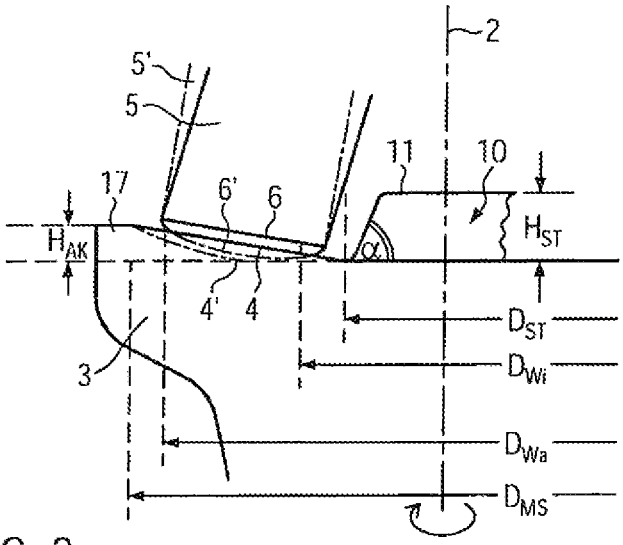
Figure 3:
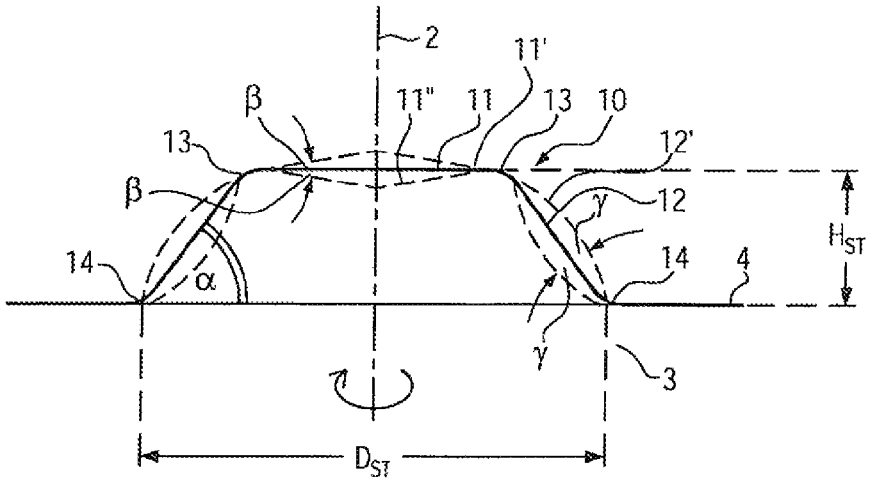

The invention is explained in greater detail below by reference to drawings, in which:

FIG. 1 shows a cutout of an inventive grinding mill with a grinding pan and a distributing plate:

FIG. 2 a cutout of an alternative inventive roller mill with a grinding pan and a distributing plate;

FIG. 3 a truncated cone shaped distributing plate and

Figure 4:
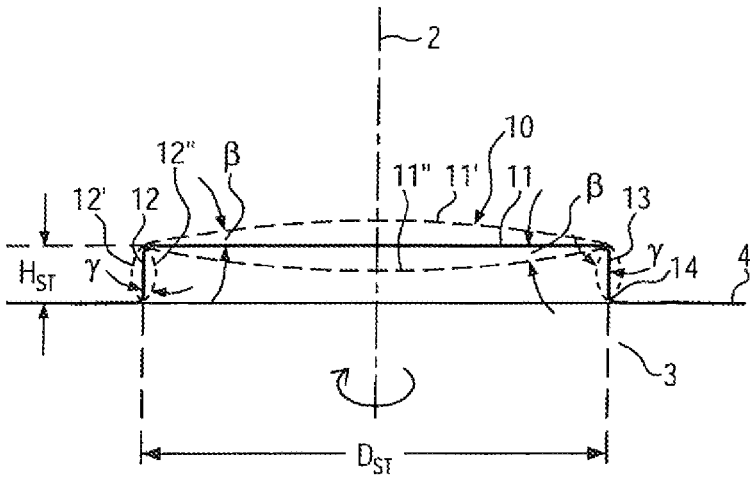

FIG. 4 a circularly cylindrical distributing plate.

FIG. 1 shows a cutout of a roller mill with a mill axis 2, a rotating grinding pan 3 and grinding rollers 5 rolling thereon, whereby only the left part of the grinding pan and only one grinding roller are shown in the partial illustration.

The grinding pan 3 comprises a planar grinding track 4 which is defined on the outer periphery by a retention rim 15 with the height $H_{SR}$.

In the central region of the grinding pan 3 a grinding material distributor 7 is disposed which is integrated in this embodiment into the grinding pan. In principle the grinding material distributor can also be a separate component and be formed so that it can be subsequently supplied or exchanged.

The grinding material distributor 7 is formed as a distributing plate 10 and has the form of a truncated cone with the height $H_{ST}$ and a diameter $D_{ST}$ in the bottom side region, that is to say at the level of the grinding track 4.

The grinding rollers 5 rolling on the grinding track 4 or respectively on a grinding bed (not shown) formed thereon define a running circuit which is formed as a circular ring and has an inner diameter $D_{Wi}$ and an outer diameter $D_{Wa}$. Half of the difference between the outer diameter and inner diameter of the running circuit of the grinding rollers corresponds essentially to the width of a circumferential surface 6 of the grinding rollers 5 which are conically formed and point with end faces 8 in the direction of the mill axis 2. The grinding pan 3 has in this example a diameter $D_{MS}$ of around 5.6 m and a retention rim height $H_{SR}$ of 0.35. The inner diameter $D_{Wi}$ of the running circuit of the grinding rollers is around 3.95 m and the outer diameter $D_{Wa}$ of the running circuit of the grinding rollers 5 is around 5.5 m. The grinding track width is thus $$\frac{D_{Wa} - D_{Wi}}{2} \approx 0,76 \text{ m}$$

The centrally arranged distributing plate 10 formed as a truncated cone is formed with a planar feed area 11 and arranged below a central grinding material feed (not shown) so that the grinding material flows away onto the feed area 11 and thereafter under the effect of gravity via a shell surface 12 of the distributing plate 10 onto the grinding track 4 and reaches the incorporation area of the grinding rollers 5.

The distance between the distributing plate 10 and the grinding rollers 5 is defined via the diameter $D_{ST}$ of the distributing plate 10 at the level of the grinding track 4 and via the inner diameter $D_{Wi}$ of the running circuit of the grinding rollers 5 and in the present embodiment this distance is 350 mm. This distance thus corresponds to the correlation 80 mm$\leq$½[$D_{Wi}$−$D_{ST}$]$\leq$400 mm.

The feed area 11 and the shell surface 12 of the distributing plate 10 are both planar in the embodiment of FIG. 1. The frustum angle α is approximately 65°.

FIG. 2 shows a left half of an alternative embodiment of a grinding pan 3 with an inclined grinding track 4, which is shown in solid lines in the same way as the associated grinding rollers 5, of which only one is again shown, and with an alternative, troughed grinding track 4', which is shown in dashed and dotted lines in the same way as the grinding rollers 5' rolling thereon, and with a discharge edge 17 on the outer periphery of the grinding pan 3. The discharge edge 17 has a height $H_{AK}$ of 300 mm, while the distributing plate 10 in the centre of the grinding pan 3 has a height $H_{ST}$ of 335 mm. The grinding pan diameter $D_{MS}$ in this example is 4500 mm, the inner diameter $D_{Wi}$ of the running circuit of the grinding rollers 5 is 2700 mm, the outer diameter $D_{Wa}$ of the running circuit of the grinding rollers 5 is 4200 mm and the distributing plate diameter $D_{ST}$ measures 1980 mm, while the diameter of the feed area 11 is 1800 mm.

Using the example of the distributing plate according to FIG. 3 it is illustrated that upper transition regions 13 and lower transition regions 14 between the feed area 11 and the shell surface 12 or respectively between the shell surface 12 and the grinding track 4 are formed as curves. It is also shown in dashed lines that the feed area 11 can be upwardly or downwardly inclined in the direction of the mill axis 2 and concavely or convexly formed with an inclination angle β of maximum 10°, whereby feed areas 11', 11" are formed. The shell surface 12 of the distributing plate 10 can, besides having a planar surface, also be formed in a concavely or convexly curved manner, whereby in this case the angle γ can be maximum 5°. These shell surfaces are indicated by the reference numerals 12' and 12".

FIG. 4 shows a circularly cylindrical distributing plate 10 with a planar feed area 11 and vertically orientated shell surface 12. The diameter of the feed area 11 and the diameter $D_{ST}$ at the level of the grinding track 4 coincide here. The transition regions 13, 14 are again formed rounded and it is indicated in dashed lines that the feed area 11, besides having a planar formation, can also have a formation which is upwardly or downwardly inclined in the direction of the mill axis 2 or a concave or convex formation. This applies in analogue manner to the shell surface 12, meaning that a circularly cylindrical distributing plate 10 can be formed with the illustrated bearing surfaces 11, 11', 11" and/or the shell surfaces 12, 12', 12" and an inclination angle β of 1 to 10° and an angle γ of 1 to 5°, in each case in relation to a horizontal feed area 11 or a vertical shell surface 12 of 0°.

In principle the distributing plate can be integrated into the grinding pan and be manufactured with it. In case of varying feed material a detachable and exchangeable arrangement of a separately produced distributing plate is advantageous so that a re-fitting is possible.

The invention claimed is:

1. Roller mill, comprising a grinding pan rotatable about a mill axis, on a grinding track of the grinding pan stationarily disposed grinding rollers roll and thereby define with their circumferential surfaces on the grinding track a running circuit with an inner diameter $D_{Wi}$ and an outer diameter $D_{Wa}$, a grinding material distributor for grinding material to be reduced, which grinding material distributor is disposed as an elevation in centre of the grinding pan coaxially with the mill axis, and a distributing plate is formed as the grinding material distributor having a horizontally arranged feed area for the grinding material and a diameter $D_{ST}$ at the level of the grinding track which satisfies the following mathematical relation:

$$80\text{ mm} \leq \tfrac{1}{2}[D_{Wi}-D_{ST}] \leq 400\text{ mm}$$

wherein, in the aforementioned mathematical relation, a lower value up to 80 mm is for a small roller mill having a grinding pan with a diameter of about 1.2 to 2.0 meters and a larger value up to 400 mm is for a large roller mill having a grinding pan with a diameter of about 2.1 to over 6 meters.

2. Roller mill according to claim 1, wherein the distributing plate, which is formed as a truncated cone shaped or circularly cylindrical elevation, has a height $H_{ST}$ which in relation to the height $H_{SR}$ of a retention ring on an outer periphery of the grinding pan satisfies the equation $$0.6H_{SR} \leq H_{ST} \leq 2.5\ H_{SR}.$$

3. Roller mill according to claim 2, wherein the distributing plate with a truncated cone shaped elevation has a frustum angle $\alpha$ in the range of from 45° to maximum 89°.

4. Roller mill according to claim 1, wherein the distributing plate has a greater height $H_{ST}$ than the retention ring and in that the height $H_{ST}$ of the distributing plate is 1.1 to 2.5 times the height $H_{SR}$ of the retention ring.

5. Roller mill according to claim 1, wherein the distributing plate has a feed area with a planar formation.

6. Roller mill according to claim 1, wherein the distributing plate has a feed area which is designed to be upwardly inclined in the direction of the mill axis.

7. Roller mill according to claim 6, wherein the feed area which is designed to be inclined has an inclination angle $\beta$ of maximum 10°.

8. Roller mill according to claim 1, wherein the distributing plate has a shell surface which is concavely formed and has an angle $\gamma$ of maximum 5° in relation to a straight line forming the shell surface.

9. Roller mill according to claim 8, wherein the distributing plate has an upper and lower transition region between the feed area and shell surface or respectively between the shell surface and grinding track, whereby said upper and lower transition regions are rounded off.

10. Roller mill according to claim 1, wherein the grinding track of the grinding pan has a planar formation and comprises a grinding track width, and the grinding rollers are conically formed and in that the distributing plate has a diameter $D_{ST}$ which is equal to or greater than the grinding track width of the grinding rollers according to $$D_{ST} \geq \frac{D_{Wa} - D_{Wi}}{2}.$$

11. Roller mill according to claim 1, wherein the grinding pan comprises a grinding track with inclined formation and complementarily formed conical grinding rollers roll thereon and in that the distributing plate has a height $H_{ST}$ which in relation to the height $H_{AK}$ of a discharge edge on an outer edge of the grinding pan (3) satisfies the equation $$H_{ST}:H_{AK}=1.2 \text{ to } 2.2:1.$$

12. Roller mill according to claim 1, wherein the distributing plate comprises a feed area which is designed to be downwardly inclined in the direction of the mill axis.

13. Roller mill according to claim 12, wherein the feed area which is designed to be inclined has an inclination angle $\beta$ of maximum 10°.

14. Roller mill according to claim 1, wherein the distributing plate comprises a feed area which is designed to be concavely curved in the direction of the mill axis.

15. Roller mill according to claim 14, wherein the feed area with curved formation has an inclination angle $\beta$ of maximum 10°.

16. Roller mill according to claim 1, wherein the distributing plate comprises a feed area which is designed to be convexly curved in the direction of the mill axis.

17. Roller mill according to claim 16, wherein the feed area with curved formation has an inclination angle $\beta$of maximum 10°.

18. Roller mill according to claim 1, wherein the distributing plate comprises a shell surface which is convexly shaped and has an angle $\gamma$ of maximum 5° in relation to a straight line forming the shell surface.

19. Roller mill according to claim 1, wherein the grinding pan comprises a through shaped grinding track on which complementarily formed spherical grinding rollers roll and that the distributing plate has a height $H_{ST}$ which in relation to the height $H_{AK}$ of a discharge edge on an outer edge of the grinding pan satisfies the equation $$H_{ST}: H_{AK}=1.2 \text{ to } 2.2:1.$$

* * * * *